US009291963B1

(12) United States Patent
Washino

(10) Patent No.: US 9,291,963 B1
(45) Date of Patent: Mar. 22, 2016

(54) IMAGE FORMING APPARATUS

(71) Applicant: FUJI XEROX CO., LTD., Tokyo (JP)

(72) Inventor: Shigeki Washino, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/795,681

(22) Filed: Jul. 9, 2015

(30) Foreign Application Priority Data

Feb. 23, 2015 (JP) ..... 2015-033132

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
USPC ..... 399/69, 68
See application file for complete search history.

(56) References Cited

U.S. PATENT DOCUMENTS 5,285,247 A * 2/1994 Itoh ..... G06K 15/12 399/86
7,865,126 B2 * 1/2011 Matsuduki ..... G03G 15/652 399/320
7,970,301 B2 * 6/2011 Degruchy ..... G03G 15/6573 399/156
2012/0237231 A1 * 9/2012 Ohshima ..... G03G 15/5029 399/45

FOREIGN PATENT DOCUMENTS

| | | | |
|---|---|---|---|
| JP | 2002333744 A | * | 11/2002 |
| JP | 2003-149885 A | | 5/2003 |
| JP | 2004233437 A | * | 8/2004 |
| JP | 2009-093113 A | | 4/2009 |
| JP | 2010-212745 A | | 9/2010 |
| JP | 2011039253 A | * | 2/2011 |
| JP | 2012048131 A | * | 3/2012 |

* cited by examiner

*Primary Examiner* — Susan Lee
(74) *Attorney, Agent, or Firm* — Oliff PLC

(57) ABSTRACT

Provided is an image forming apparatus including a fixing unit that fixes a developer image which is formed on a thermoplastic recording medium by performing fixing processing that causes the recording medium on which the developer image is formed to be heated and pressed with transportation based on plural fixation parameters, a detection unit that detects an amount of extension and contraction which occurs in the recording medium by the fixing processing, and a suppression unit that controls at least one of the plural fixation parameters and suppresses the amount of extension and contraction which is detected by the detection unit.

20 Claims, 11 Drawing Sheets

IMAGE FORMING APPARATUS

CROSS-REFERENCE TO RELATED APPLICATIONS

This application is based on and claims priority under 35 USC 119 from Japanese Patent Application No. 2015-033132 filed Feb. 23, 2015.

BACKGROUND

Technical Field

The present invention relates to an image forming apparatus.

For example, when an image is formed by using an electrophotographic process, fixing processing in which a recording medium such as a film, on which a developer image is formed is heated and thus the developer image is fixed on the recording medium is performed.

Expansion or contraction may occur in the recording medium when heating and fixing are performed. If extension and contraction occur in the recording medium, extension and contraction also occur in an image which has been formed on the recording medium.

SUMMARY

According to an aspect of the invention, there is provided an image forming apparatus including:

a fixing unit that fixes a developer image which is formed on a thermoplastic recording medium by performing fixing processing that causes the recording medium on which the developer image is formed to be heated and pressed with transportation based on plural fixation parameters;

a detection unit that detects an amount of extension and contraction which occurs in the recording medium by the fixing processing; and a suppression unit that controls at least one of the plural fixation parameters and suppresses the amount of extension and contraction which is detected by the detection unit.

BRIEF DESCRIPTION OF THE DRAWINGS

Exemplary embodiments of the present invention will be described in detail based on the following figures, wherein.

DETAILED DESCRIPTION

Hereinafter, exemplary embodiments according to the invention will be described in detail with reference to the accompanying drawings.

First Exemplary Embodiment

Figure 1:
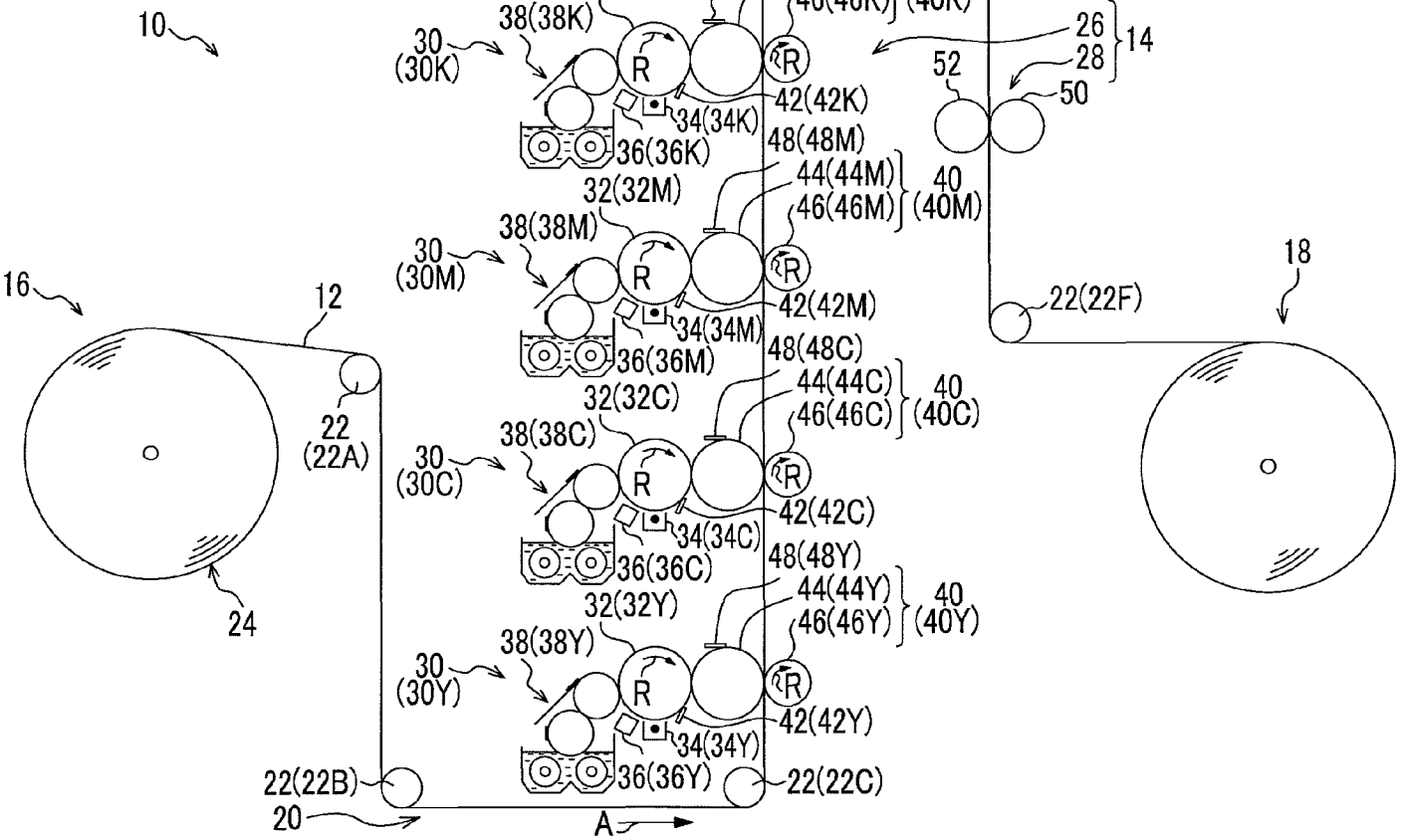
FIG. 1 is a configuration diagram of main components illustrating an example of an image forming apparatus according to a first exemplary embodiment.

FIG. 1 illustrates main components of an image forming apparatus 10 according to the first exemplary embodiment. The image forming apparatus 10 forms an image on a recording medium by performing an electrophotographic process, while the recording medium is transported. In the first exemplary embodiment, a long plastic film (below referred to as a film 12) is used as an example of the recording medium. Examples of the film 12 include various types of synthetic resin having thermoplasticity (thermoplastic synthetic resin), for example, polyolefin-based resin such as polypropylene (PP), polyethylene (PE), and polyethylene terephthalate (PET). Examples of the film 12 are not limited thereto and may include synthetic resin having thermoplasticity, for example, polyester, polystyrene, and polyvinyl alcohol.

The image forming apparatus 10 is applied in image forming processing which is performed on a recording medium having thermoplasticity such as a sheet in addition to the film 12. In the first exemplary embodiment, an example of using the long film 12 will be described, but the recording medium is not limited to having a long length and may have a sheet-like shape.

Image data of an image which will be formed on the film 12 is input to the image forming apparatus 10. The image data may be input through, for example, a communication line such as a dedicated network line or a public network line to which the image forming apparatus 10 is connected. An image reading apparatus which reads an image which is recorded on an original document may be connected to the image forming apparatus 10. An image data obtained by the image reading apparatus reading the image which is recorded on the original document may be input to the image forming apparatus 10. A storage medium reading apparatus may be connected to the image forming apparatus 10 and a known configuration may be applied. An example of the known configuration is that the storage medium reading apparatus reads image data which is stored in a storage medium and thus the image data is input to the image forming apparatus 10.

The image forming apparatus 10 includes an image forming section 14, a supply section 16, and an exit section 18. A transporting path 20 for the film 12 is formed in the image forming apparatus 10. Plural transport rolls 22 are formed to be arranged in the transporting path 20. In the first exemplary embodiment, the transporting path 20 and the transport rolls 22 function as an example of a transporting unit. In the image forming apparatus 10, at least some of the transport rolls 22 are rotatably driven and thus the film 12 is transported along the transporting path 20 at a preset transportation speed and a preset tensile strength (the transportation direction is illustrated by a direction of an arrow A). FIG. 1 illustrates transport rolls 22A, 22B, 22C, 22D, 22E, and 22F, as an example. However, in the following descriptions, if the transport rolls are not required to be distinguished, the transport rolls 22A, 22B, 22C, 22D, 22E, and 22F are generally referred to as the transport roll 22.

A film roll 24 is loaded in the supply section 16. The film roll 24 is obtained by winding the long film 12 having a preset width dimension so as to have a roll shape. The supply section 16 draws the film 12 from an outer peripheral edge of the film roll 24 and transfers the drawn film 12 to the transporting path 20. Thus, the film 12 is transported to the exit section 18 from the supply section 16 along the transporting path 20 through the image forming section 14. The exit section 18 stores the film 12 which is wound so as to have a roll shape.

The image forming section 14 includes a developing section 26 and a fixing section 28. The developing section 26 forms a developer image on the film 12 in such a manner that a latent image which is formed in accordance with the image data is developed by using a developer. The fixing section 28 is provided on a downstream side of the developing section 26 and fixes the developer image which has been formed on the film 12, on the film 12. In the first exemplary embodiment, the fixing section 28 functions as an example of a fixing unit.

The image forming section 14 forms a color image on the film 12 by using developers respectively having colors of Y, M, C, and K, for example. In the following descriptions, an attached reference sign of Y indicates a component for a yellow color, an attached reference sign of M indicates a component for a magenta color, an attached reference sign of C indicates a component for a cyan color, and an attached reference sign of K indicates a component for a black color. In the following descriptions, if the colors are not required to be distinguished, attachment of the reference signs of Y, M, C, and K will be omitted.

The developing section 26 includes an image forming unit 30Y, an image forming unit 30M, an image forming unit 30C, and an image forming unit 30K, as an image forming unit 30. The image forming unit 30Y uses a developer containing a yellow toner. The image forming unit 30M uses a developer containing a magenta toner. The image forming unit 30C uses a developer containing a cyan toner. The image forming unit 30K uses a developer containing a black toner. The image forming units 30Y, 30M, 30C, and 30K are sequentially arranged in the developing section 26 along the transporting path 20.

The image forming unit 30 (30Y, 30M, 30C, and 30K) includes a photoconductor 32 (32Y, 32M, 32C, and 32K), a charging device 34 (34Y, 34M, 34C, and 34K), and an exposure device 36 (36Y, 36M, 36C, and 36K). The image forming unit 30 (30Y, 30M, 30C, and 30K) includes a developing device 38 (38Y, 38M, 38C, and 38K), a transferring device 40 (40Y, 40M, 40C, and 40K), and a cleaner 42 (42Y, 42M, 42C, and 42K).

The photoconductor 32 is formed to be cylindrical as an example, and holds an electrostatic latent image on an outer circumference surface of the photoconductor 32. The photoconductor 32 is rotated in a direction (a direction of an arrow R in FIG. 2) which is preset in accordance with the transportation speed of the film 12 which is transported along the transporting path 20. The charging device 34, the exposure device 36, the developing device 38, the transferring device 40, and the cleaner 42 are sequentially disposed around the photoconductor 32 in a rotation direction of the photoconductor 32. Each of the charging device 34, the exposure device 36, the developing device 38, the transferring device 40, and the cleaner 42 faces the outer circumference surface of the photoconductor 32.

For example, the charging device 34 uses a corotron, a scorotron, or the like, and charges the outer circumference surface of the photoconductor 32 which faces the charging device 34 by applying a charged voltage which is defined in advance. The exposure device 36 scans and irradiates the charged outer circumference surface of the photoconductor 32 with, for example, a light beam.

In the image forming apparatus 10, image processing which is set in advance is performed on image data. Color separation is performed on the image data which is subjected to the image processing and thus raster data (bitmap data) for each of colors of Y, M, C, and K, for example, is generated. The exposure device 36 performing scanning of and irradiation with a light beam in accordance with the raster data under a control based on the raster data, and thus forms an electrostatic latent image corresponding to the raster data, on the photoconductor 32.

The developing device 38 uses a liquid developer or a powder developer as the developer. The developing device 38 supplies the developer to the outer circumference surface of the photoconductor 32 on which the electrostatic latent image is formed, and thus forms a developer image corresponding to the electrostatic latent image, on the outer circumference surface of the photoconductor 32. Thus, a developer image corresponding to a Y color component of the image data is formed on the photoconductor 32Y. A developer image corresponding to an M color component of the image data is formed on the photoconductor 32M. A developer image corresponding to a C color component of the image data is formed on the photoconductor 32C. A developer image corresponding to a K color component of the image data is formed on the photoconductor 32K.

The transferring device 40 includes an intermediate transfer roll 44 (44Y, 44M, 44C, and 44K) and a transfer roll 46 (46Y, 46M, 46C, and 46K). The intermediate transfer roll 44 is drivenly rotated by rotation of the photoconductor 32 in a state where an outer circumference surface of the intermediate transfer roll 44 comes into contact with the outer circumference surface of the photoconductor 32 at a preset position (primary transfer position) on a downstream side of the developing device 38 in the rotation direction of the photoconductor 32. The intermediate transfer roll 44 is disposed such that the outer circumference surface of the intermediate transfer roll 44 comes into contact with the film 12 which is transported along the transporting path 20, at a secondary transfer position on an opposite side of the primary transfer position. The transfer roll 46 is disposed to face the intermediate transfer roll 44 with the transporting path 20 interposed between the transfer roll 46 and the intermediate transfer roll 44 at the secondary transfer position. The transfer roll 46 is rotated (rotated in a direction of an arrow R) such that the film 12 which has been transported along the transporting path 20 is sent out in a state where the film 12 is interposed between the transfer roll 46 and the intermediate transfer roll 44.

In the image forming unit 30, a primary transfer voltage is applied to the intermediate transfer roll 44 from a power supply device (not illustrated) and thus a toner image which is formed on the photoconductor 32 is primarily transferred to the outer circumference surface of the intermediate transfer roll 44 at the primary transfer position. In the image forming unit 30, a secondary transfer voltage is applied to the transfer roll 46 from the power supply device (not illustrated), and thus the toner image which has been transferred to the intermediate transfer roll 44 is transferred onto the film 12 at the secondary transfer position.

In the developing section 26, the developer images of colors which are respectively formed by the image forming units 30Y, 30M, 30C, and 30K are transferred to be sequentially stacked on the film 12, and thus a developer image (color developer image) corresponding to the image data is formed on the film 12 as a developer image. The cleaner 42 removes residual developers from the outer circumference surface of the photoconductor 32 in which primary transfer is complete. Secondary transfer is complete in the intermediate transfer roll 44 and then a cleaner 48 (48Y, 48M, 48C, and 48K) removes residual developers from the outer circumference surface of the intermediate transfer roll 44.

Figure 2:
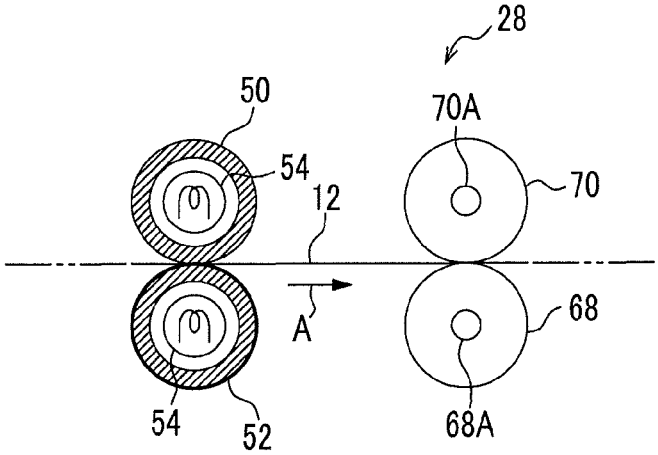
FIG. 2 is a configuration diagram of main components illustrating an example of a fixing section according to the first exemplary embodiment.

FIG. 2 illustrates a configuration of main components of the fixing section 28. As illustrated in FIGS. 1 and 2, the fixing section 28 includes a fixing roll 50 and a pressure roll 52. As illustrated in FIG. 2, a heater 54 is provided in the fixing roll 50 as a heating unit, for example. As the heater 54, a known heating unit such as a halogen lamp may be used. The heater 54 heats the fixing roll 50 such that an outer circumference surface of the fixing roll 50 has a fixation temperature which is set in advance. The pressure roll 52 is biased toward the fixing roll 50 by a pressure unit (not illustrated), whereby preset fixation pressure is applied to the film 12 which comes into contact with the fixing roll 50. In the first exemplary embodiment, as an example, the heater 54 is also provided in the pressure roll 52 in addition to the fixing roll 50, and thus the film 12 is heated by the fixing roll 50 and the pressure roll 52.

Figure 3:
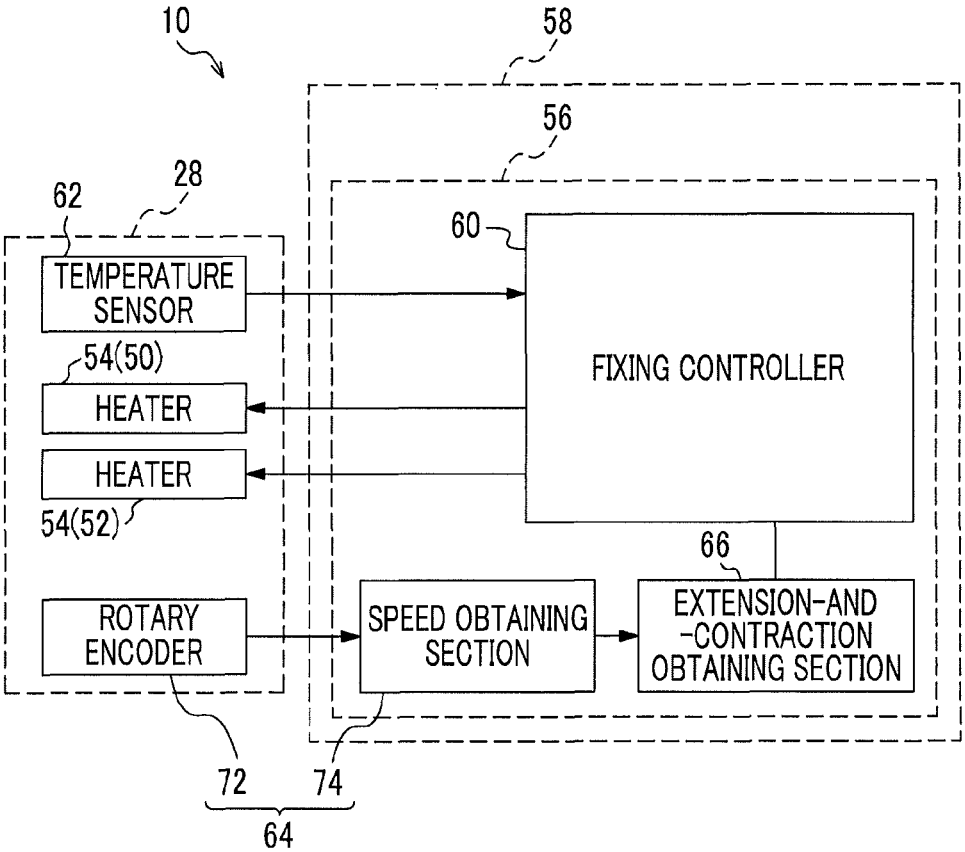
FIG. 3 is a configuration diagram of main components illustrating an example of a fixation control section according to the first exemplary embodiment.

FIG. 3 illustrates main components of a fixation control section 56 which controls an operation of the fixing section 28. A control section 58 for controlling an operation of the image forming apparatus 10 is provided in the image forming apparatus 10. The control section 58 of the image forming apparatus 10 includes a computer (not illustrated) which has a general configuration in which a central processing unit (CPU), a random access memory (RAM), a read only memory (ROM), and a non-volatile memory such as a hard disk drive (HDD) are connected to each other through a bus. The CPU executes various control programs which are stored in the non-volatile memory whereby the computer is caused to function as the control section 58 that controls an operation of the image forming apparatus 10. The various control programs which will be executed by the CPU are stored in a storage medium such as a CD-ROM and a DVD and the stored control programs may be read and executed by a CD-ROM drive, a DVD drive, and the like which are connected to the computer. The control program which is executed by the CPU may be obtained by the computer through a communication line.

A fixation control program is included as the control program which is executed by the CPU of the computer included in the control section 58. Thus, the CPU executes the fixation control program and thus the computer functions as the fixation control section 56.

A fixing controller 60 is provided in the fixation control section 56. In the first exemplary embodiment, the fixing controller 60 includes a function as the fixing unit and functions as an example of a suppression unit. In the first exemplary embodiment, as an example, the heater 54 is provided in each of the fixing roll 50 and the pressure roll 52. These heaters 54 are connected to the fixing controller 60. A temperature sensor 62 is connected to the fixing controller 60. The temperature sensor 62 detects, for example, the temperature of the outer circumference surface of the fixing roll 50 in a non-contact manner.

Fixation parameters when an image is formed on the film 12 through the electrophotographic process include a fixation temperature, a fixation pressure, a transportation speed of the film 12, a tensile strength (tension) applied to the film 12, and the like. The fixing controller 60 sets the fixation temperature among the fixation parameters, and controls an operation of the heater 54 based on the fixation temperature which has been set, such that the temperature of the outer circumference surface of the fixing roll 50 which is detected by the temperature sensor 62 is held to be the fixation temperature. The fixing section 28 may have a known configuration in which the film 12 is heated and thus the toner image is fixed on the film 12. Detailed descriptions of the fixing section 28 which includes the fixing roll 50 and the pressure roll 52 will be omitted.

As illustrated in FIG. 1, the film 12 onto which the toner image is transferred passes through the fixing section 28 in a state where the preset tensile strength is applied, while transportation is performed at the preset transportation speed. In the fixing section 28, the film 12 which passes through the fixing section 28 is sent off in a state where the film 12 is interposed between the fixing roll 50 and the pressure roll 52. At this time, in the fixing section 28, the film 12 is heated by the fixing roll 50 and the pressure roll 52, and is pressed by the pressure roll 52. The film 12 is heated and pressed in the fixing section 28 and thus the developers on the developer image are melted and fixed. Thus, an image corresponding to the image data is formed. As a basic configuration of the image forming apparatus 10, a known configuration which is used in the electrophotographic process may be applied and thus detailed descriptions thereof will be omitted in the first exemplary embodiment.

As illustrated in FIG. 3, a speed detection section 64 and an extension-and-contraction obtaining section 66 are provided in the fixing section 28 of the image forming apparatus 10. The speed detection section 64 and the extension-and-contraction obtaining section 66 in the first exemplary embodiment function as an example of a detection unit. The speed detection section 64 in the first exemplary embodiment functions as an example of a first speed detection unit.

As illustrated in FIG. 2, a rotation roll 68 and a rotation roll 70 are provided in the fixing section 28 (not illustrated in FIG. 1). The rotation roll 68 faces a back surface (surface on an opposite side of a surface on which an image is formed) of the film 12 and the rotation roll 70 faces a surface (surface on which an image is formed) of the film 12. The rotation rolls 68 and 70 form a pair which causes the transporting path 20 to be interposed between the rotation rolls 68 and 70 and are disposed on a downstream side of the fixing roll 50 and the pressure roll 52. The rotation rolls 68 and 70 are supported so as to be freely rotated by a support unit in which rotation shafts 68A and 70A are not illustrated. The film 12 which is subjected to the fixing processing comes into contact with outer circumference surfaces of the rotation rolls 68 and 70. Thus, the rotation rolls 68 and 70 track transportation of the film 12 and are rotated, and the film 12 is sent off in a state of being interposed.

As illustrated in FIG. 3, the speed detection section 64 includes a rotary encoder (below referred to as an R-encoder) 72 and a speed obtaining section 74. As the R-encoder 72, a general configuration in which a rotation shaft (not illustrated) is rotated and thus a pulse (below referred to as a pulse signal) corresponding to the rotation of the rotation shaft is output may be applied.

In the R-encoder 72, the rotation shaft (not illustrated) is linked to the rotation shaft of one rotation roll of the rotation rolls 68 and 70 (see FIG. 2). In the first exemplary embodiment, as an example, the rotation shaft of the R-encoder 72 is linked to the rotation shaft 68A of the rotation roll 68. Accordingly, in the R-encoder 72, the rotation roll 68 rotates at a rotation speed corresponding to the transportation speed of the film 12, and thus a pulse signal having the number of pulses is output and at this time, the number of pulses per a unit time is the number of pulses in accordance with the transportation speed of the film 12.

Regarding the extension-and-contraction obtaining section 66 and the speed obtaining section 74, for example, a CPU of the computer included in the control section 58 of the image forming apparatus 10 executes an extension-or-contraction obtaining program and a speed obtaining program, and thus the computer functions as the extension-and-contraction obtaining section 66 and the speed obtaining section 74.

The speed obtaining section 74 is connected to the R-encoder 72 and a pulse signal is input to the speed obtaining section 74 from the R-encoder 72. The speed obtaining section 74, for example, counts the number of pulses in the pulse signal which is input from the R-encoder 72 and obtains a transportation speed Va of the film 12 which is subjected to the fixing processing, from a count value per a unit time. In the first exemplary embodiment, the transportation speed Va functions as an example of a transportation speed after the fixing processing. The speed obtaining section 74 outputs the obtained transportation speed Va of the film 12 to the extension-and-contraction obtaining section 66. In the following descriptions, the transportation speed includes a meaning of a movement speed at a certain point on the film 12.

The extension-and-contraction obtaining section 66 sets the transportation speed of the film 12 on the transporting path 20 of the image forming apparatus 10 as a transportation speed Vb of the film 12 before the fixing processing. The extension-and-contraction obtaining section 66 calculates a rate of extension and contraction Rs in the transportation direction of the film 12 after the fixing processing, based on the transportation speed Va and the transportation speed Vb. In the first exemplary embodiment, the rate of extension and contraction Rs functions as an example of an amount of extension and contraction. When no extension and contraction occur in the film 12 which is subjected to the fixing processing, there is no difference (Va=Vb) between the transportation speed of the film 12 before the fixing processing and the transportation speed of the film 12 after the fixing processing. On the contrary, for example, if the film 12 is extended by the fixing processing, the transportation speed Va of the film after the fixing processing is higher than the transportation speed Vb of the film 12 before the fixing processing (Va>Vb). The rate of extension and contraction in the transportation direction of the film 12 is obtained from, for example, a ratio of the transportation speed before the fixing processing and the transportation speed after the fixing processing (for example, $Rs=((Va/Vb)-1)\times 100(\%)$, extension when $Rs>0$, contraction when $Rs<0$, and no extension and contraction when $Rs=0$).

The long film 12 is partially extended in a longitudinal direction, whereby contraction in an extended area may occur in a width direction. The long film 12 is contracted in the longitudinal direction, whereby extension in a contracted area may occur in the width direction. The extension and contraction of the film 12 in the width direction are defined by a material of the film 12, the thickness of the film 12, and the like. However, the extension and contraction have a value corresponding to the rate of extension and contraction Rs in the transportation direction (longitudinal direction). If the extension and contraction in the film 12 occur in at least one of the longitudinal direction and the width direction, extension and contraction depending on the extension and contraction which occur in the film 12 occur in an image which is formed on the film 12.

Accordingly, it is possible to predict extension and contraction of an image which is formed on the film 12, by detecting the extension and contraction in the transportation direction of the film 12. The extension and contraction in the width direction is suppressed by suppressing the extension and contraction in the film 12 in the transportation direction. Occurrence of the extension and contraction in an image which is formed on the film 12 is suppressed by suppressing the extension and contraction of the film 12.

Here, the extension and contraction by the fixing processing in the transportation direction of the film 12 vary depending on the fixation temperature, the fixation pressure, the transportation speed of the film 12, the tensile strength (tension) which is applied to the film 12, and the like. As described above, in the image forming apparatus 10, the transportation speed of the film 12 and the tensile strength applied to the film 12 are set in advance, and the film 12 is transported at the transportation speed which has been set, in a state where the tensile strength which has been set is applied. In the fixing section 28 of the image forming apparatus 10, the fixation pressure which has been set in advance is applied to the film 12 by using a pressing mechanism which is provided in the pressure roll 52. For this reason, in the image forming apparatus 10, the fixation temperature is used as an example of the fixation parameter for suppressing the extension and contraction which occur in the film 12, and the extension and contraction of the film 12 are suppressed by suppressing the fixation temperature in the fixing section 28.

In the image forming apparatus 10, regarding of the film 12 of the film roll 24 which is loaded in the supply section 16, variation in the rate of extension and contraction Rs for a temperature variation (temperature $\Delta T$) in the fixation temperature Tf is obtained in advance and stored in a storage unit such as a non-volatile memory (not illustrated). The fixing controller 60 receives the rate of extension and contraction Rs of the film 12 which is input from the extension-and-contraction obtaining section 66. Thus, the fixing controller 60 sets a correction value (temperature $\Delta T$) of the fixation temperature Tf which is the fixation parameter which causes the extension and contraction of the film 12 to be suppressed, in accordance with the input rate of extension and contraction Rs. The fixing controller 60 performs the fixing processing on the film 12 in such a manner that the fixation temperature Tf is corrected based on the correction value which has been set, and heating of the heater 54 is controlled based on the corrected fixation temperature Tf.

Next, correction processing of the fixation temperature Tf which is one of the fixation parameters will be described as effects of the first exemplary embodiment. In the image forming apparatus 10, the film 12 is extracted from the film roll 24 which is loaded in the supply section 16, and an toner image corresponding to image data is transferred onto the film 12 while the extracted film 12 is transported. In the image forming apparatus 10, when the film 12 onto which the toner image is transferred passes through the fixing section 28, the film 12 is heated and pressed. Thus, the toner image is melted and fixed on the film 12 and an image corresponding to the image data is formed.

The film 12 which is subjected to the fixing processing is heated and softened, and thus the extension and contraction easily occur. That is, the film 12 is heated in a state where tension is applied, and thus is easily extended in the transportation direction and contraction in the width direction easily occurs with extension of the film 12. Occurrence of the extension and contraction in the film 12 causes extension and contraction to occur in an image which is formed on the film 12. Thus, the image which is formed on the film 12, and finish of the film 12 on which the image is formed are damaged. Here, the fixation control section 56 which is provided in the image forming apparatus 10 suppresses the extension and contraction of the film 12, and thus attempts suppression of the extension and contraction of the image which is formed on the film 12.

Figure 4:
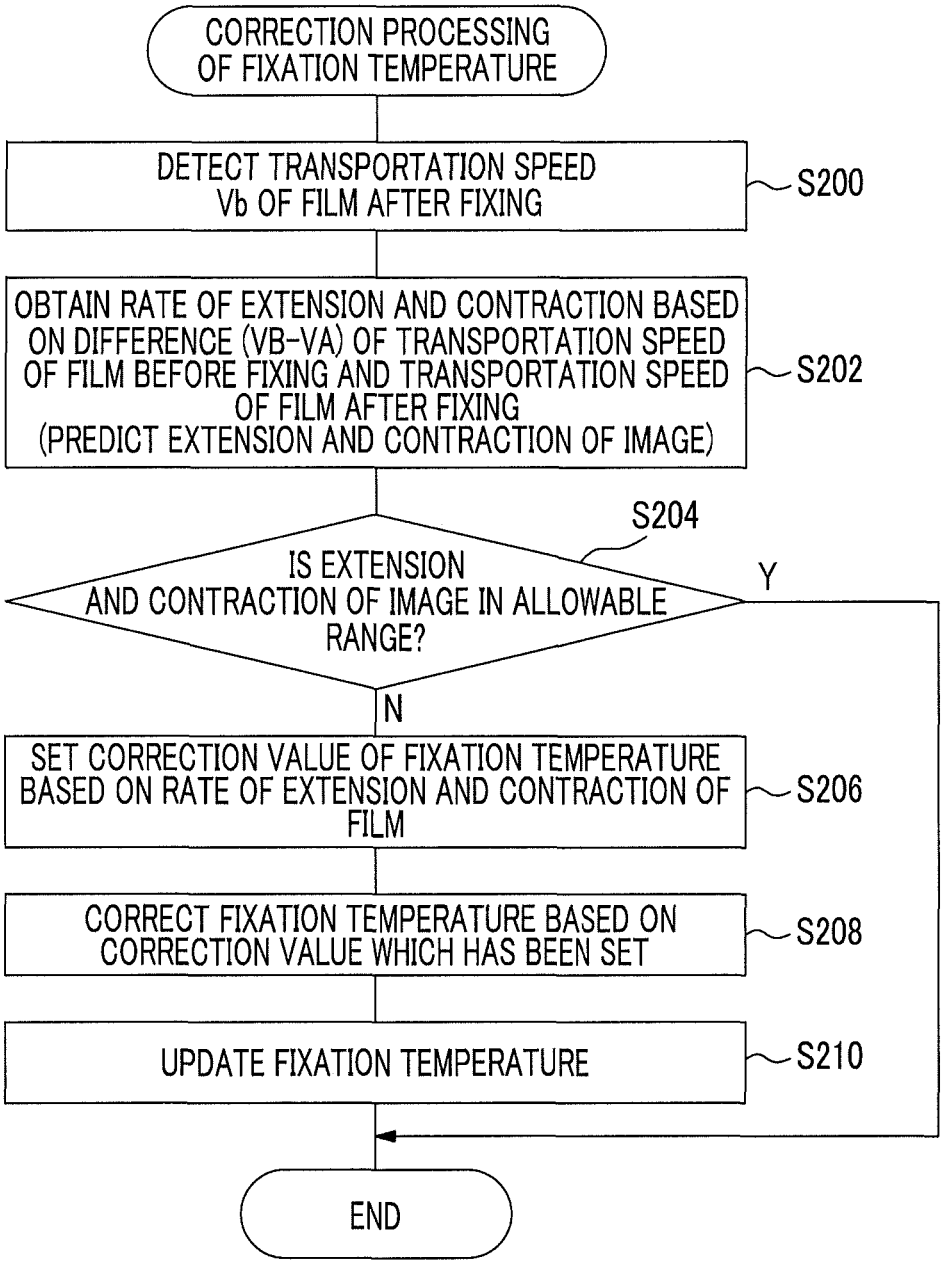
FIG. 4 is a flowchart illustrating an example of correction of a fixation parameter according to the first exemplary embodiment.

FIG. 4 illustrates an example of the correction processing of the fixation temperature Tf in order to suppress the extension and contraction of an image. The fixation control section 56 sets a temperature which is set ahead of the fixing processing as the fixation temperature Tf. The fixing processing which is performed on the film 12 is allowed by the fixing roll 50 being held at the fixation temperature Tf. After performing of the fixing processing is enabled, the fixation control section 56 performs the correction processing at a timing which is set in advance regarding of the fixation temperature Tf. The correction processing of the fixation temperature Tf is performed for every preset time from when processing starts to be performed on the film 12 which is extracted from the film roll 24 or for every preset throughput (every time the length of the processed film 12 reaches a preset length), every time a new film roll 24 is loaded in the supply section 16.

In a flowchart of FIG. 4, a start of transporting the film 12 causes the processing to be performed. In the first Step 200, the transportation speed Va of the film 12 after the fixing processing is detected. The transportation speed Va is detected by counting the number of pulses in a pulse signal which is output by the R-encoder 72 in accordance with the transportation speed of the film 12.

In Step 202, the transportation speed of the film 12 which is set in the image forming apparatus 10 is obtained as the transportation speed Vb of the film 12 before the fixing processing, and the rate of extension and contraction Rs in the transportation direction of the film 12 is obtained based on the transportation speeds Va and Vb. The rate of extension and contraction Rs of the film 12 in the transportation direction is obtained by detecting the extension and contraction of the film 12 in the transportation direction. The extension and contraction of an image which will be formed on the film 12 is predicted from the rate of extension and contraction Rs.

In Step 204, it is determined whether or not the extension and contraction occurring in an image which is formed on the film 12 is in an allowable range, based on the rate of extension and contraction Rs of the film 12 in the transportation direction. For example, in the image forming apparatus 10, the allowable range of the extension and contraction for an image which is formed on the film 12 is defined, and an allowable range (for example, an upper limit value Rc) of the rate of extension and contraction Rs of the film 12 in the transportation direction is set in accordance with the allowable range. In Step 204, it is determined whether or not the obtained rate of extension and contraction Rs of the film 12 are in the preset allowable range ($-Rc \leq Rs \leq Rc$).

Here, if the rate of extension and contraction Rs of the film 12 in the transportation direction is in the preset allowable range, it is determined to be Yes in Step 204 and the processing is ended without correction of the fixation temperature Tf.

On the contrary, if the obtained rate of extension and contraction Rs of the film 12 in the transportation direction exceeds the allowable range (for example, $Rs < -Rc$ or $Rc < Rs$), it is determined to be No in Step 204 and the process proceeds to Step 206. In Step 206, the temperature $\Delta T$ (variation amount of the temperature) which is necessary to cause the rate of extension and contraction Rs of the film 12 in the transportation direction to be in the allowable range is set as the correction value of the fixation temperature Tf based on variation of the rate of extension and contraction Rs for variation of the temperature which is set regarding of the film 12.

Then, in Step 208, the fixation temperature Tf is corrected based on the correction value (temperature $\Delta T$) which has been set, and an update is performed such that the corrected fixation temperature Tf is set as a new fixation temperature Tf (Step 210). Thus, in the fixing section 28, the fixing processing is performed on the film 12 based on the updated fixation temperature Tf. Accordingly, in the image forming apparatus 10, the extension and contraction of the film 12 by the fixing processing is suppressed, and the extension and contraction of an image which is formed on the film 12 is suppressed.

Second Exemplary Embodiment

Next, the second exemplary embodiment will be described. In the second exemplary embodiment, functional components which are equivalent to those in the first exemplary embodiment are denoted by the reference signs which are applied to the first exemplary embodiment, and detailed descriptions thereof will be omitted.

Figure 5A:
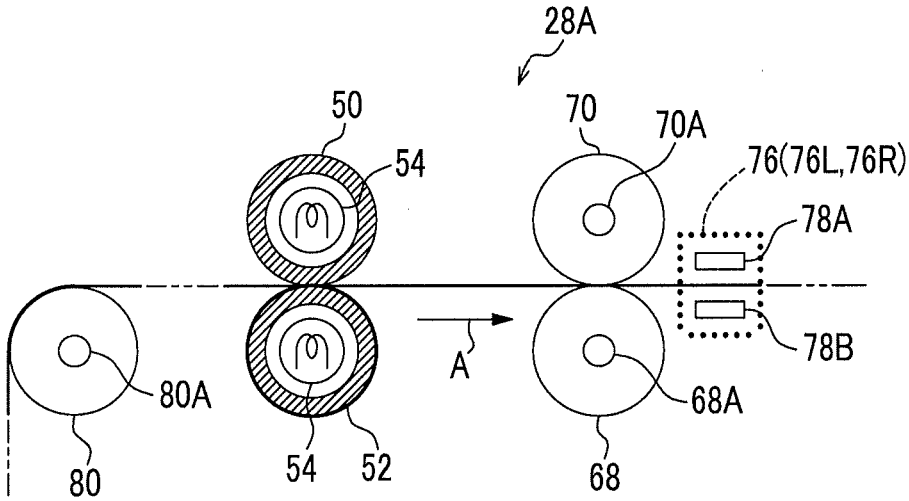
FIG. 5A is a configuration diagram of main components illustrating an example of a fixing section according to a second exemplary embodiment.
Figure 5B:
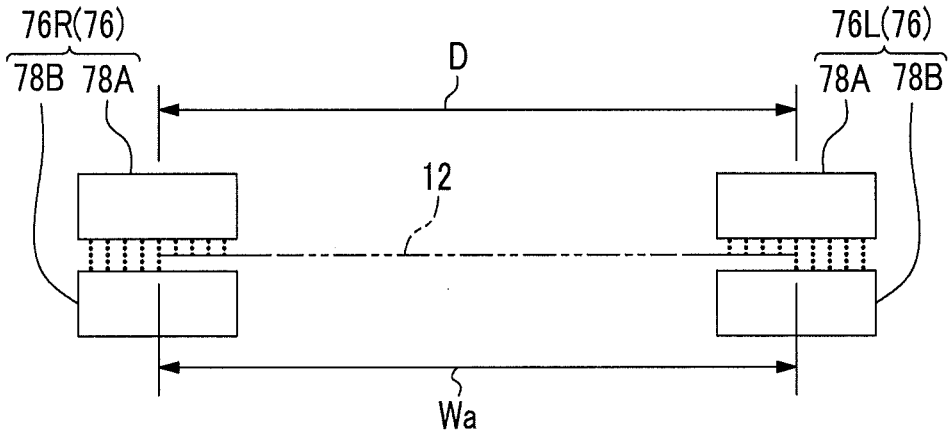
FIG. 5B is a configuration diagram of main components illustrating an example of disposition of a photoelectric sensor when viewed from a fixing roll side in FIG. 5A.

FIG. 5A illustrates main components of a fixing section 28A according to the second exemplary embodiment. In the second exemplary embodiment, the fixing section 28A functions as an example of the fixing unit. A photoelectric sensor 76 is provided on a downstream side of the rotation rolls 68 and in the fixing section 28A. In the second exemplary embodiment, the photoelectric sensor 76 functions as an example of a first width detection unit. FIG. 5B illustrates an example of disposition of the photoelectric sensor 76. The photoelectric sensor 76 includes a photoelectric sensor 76L which corresponds to one end portion of the film 12 in the width direction, and a photoelectric sensor 76R which corresponds to another end portion thereof. In the following descriptions, when the photoelectric sensors 76R and 76L are not required to be distinguished, the photoelectric sensors 76R and 76L are described as the photoelectric sensor 76.

The photoelectric sensor 76 includes a light emitting device 78A and a light receiving device 78B. The light emitting device 78A is disposed to face one surface (for example, a surface) of the film 12, and the light receiving device 78B is disposed to face another surface of the film 12. The light emitting device 78A emits light in a preset range along the width direction of the film 12. The light receiving device 78B receives the light which is emitted from the light emitting device 78A in the preset range along the width direction of the film 12. Here, a portion of light which is emitted from the light emitting device 78A is blocked at an end portion of the film 12, and thus a light reception amount of the light receiving device 78B is reduced. In the photoelectric sensor 76, for example, a position of a tip end of the film 12 in the width direction is specified based on the reduced light reception amount of the light receiving device 78B. In the second exemplary embodiment, an example in which the position of the tip end of the film 12 in the width direction is specified based on variation in the light reception amount of the light receiving device 78B will be described. However, the configuration of the photoelectric sensor 76 is not limited thereto. For example, any known configuration may be applied in the photoelectric sensor 76. An example of the known configuration is that a light receiving device in which plural light reception elements are arranged in the width direction of the film 12 is used instead of the light receiving device 78B, and a tip end position of the film 12 in the width direction is specified based on a position of the light reception element which has a reduced light reception amount.

The photoelectric sensors 76L and 76R face tip end portions of the film 12 which is subjected to the fixing processing on both sides in the width direction and a distance D between the photoelectric sensors 76L and 76R (for example, distance between center positions of a measurement range in the width direction) is set in advance. With this, in the fixing section 28A, a dimension (below referred to as a width dimension Wa) in the width direction of the film 12 after the fixing processing is obtained from tip end positions of the film 12 in the width direction, which are respectively detected by the photoelectric sensors 76L and 76R.

As illustrated in FIG. 5A, a rotation roll 80 is provided on an upper stream side of the fixing roll 50 and the pressure roll 52 in the fixing section 28A, so as to be freely rotated. The film 12 which is transported toward the fixing roll 50 and the pressure roll 52 is wound on an outer circumference surface of the rotation roll 80 in a state where a surface onto which the developer image is transferred is directed outwardly. The film 12 is transported with being wound on the outer circumference surface of the rotation roll 80 and thus the rotation roll 80 is rotated at a rotation speed in accordance with the transportation speed of the film 12 with tracking of transportation of the film 12. As the rotation roll 80, the transport roll 22E of the image forming apparatus 10 illustrated in FIG. 1 may be used.

Figure 6:
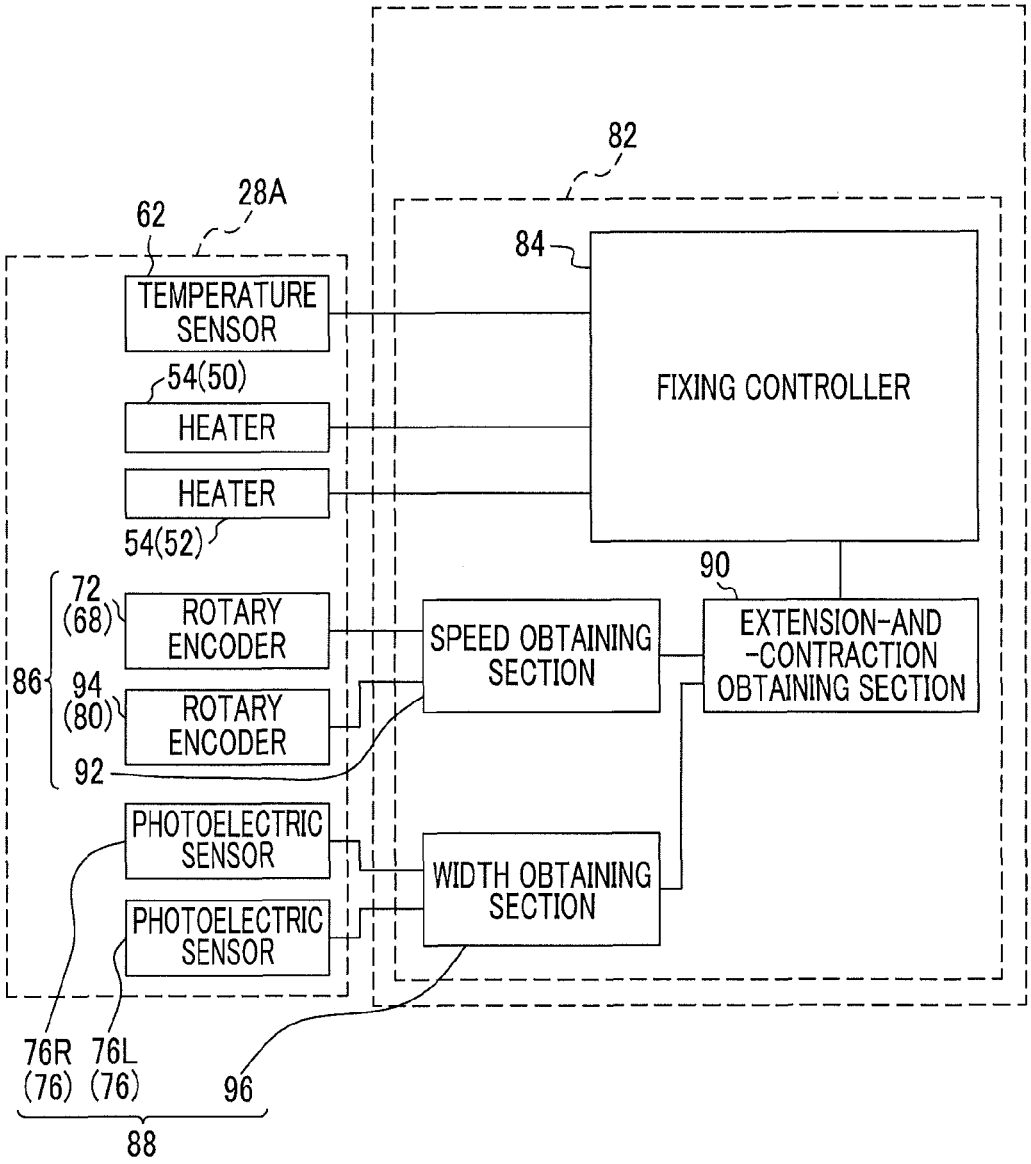
FIG. 6 is a configuration diagram of main components illustrating an example of a fixation control section according to the second exemplary embodiment.

FIG. 6 illustrates main components of a fixation control section 82 according to the second exemplary embodiment. The fixation control section 82 includes a fixing controller 84, a speed detection section 86, a width detection section 88, and an extension-and-contraction obtaining section 90. In the second exemplary embodiment, the fixing controller 84 functions as the fixing unit and functions as an example of the suppression unit. In the second exemplary embodiment, the speed detection section 86, the width detection section 88, and the extension-and-contraction obtaining section 90 function as an example of the detection unit.

The speed detection section 86 includes a speed obtaining section 92, the R-encoder 72, and an R-encoder 94. In the second exemplary embodiment, the R-encoder 72 is connected to the speed obtaining section 92, and thus the speed obtaining section 92 functions as an example of the first speed detection unit. Further, the R-encoder 94 is connected to the speed obtaining section 92, and thus the speed obtaining section 92 functions as an example of a second speed detection unit.

The R-encoder 94 is linked to a rotation shaft 80A of the rotation roll 80 (see FIG. 5A) and outputs a pulse signal in accordance with a rotation speed of the rotation roll 80. The speed obtaining section 92 obtains the transportation speed Va of the film 12 after the fixing processing from the pulse signal which is input from the R-encoder 72. The speed obtaining section 92 obtains the transportation speed Vb of the film 12 before the fixing processing from the pulse signal which is input from the R-encoder 94.

The width detection section 88 includes the photoelectric sensors 76L and 76R, and a width obtaining section 96. In the second exemplary embodiment, the width detection section 88 functions as an example of the first width detection unit. The width obtaining section 96 obtains the width dimension Wa of the film 12 after the fixing processing from the tip end positions of the film 12 in the width direction, which are respectively detected by the photoelectric sensors 76L and 76R.

The extension-and-contraction obtaining section 90 obtains the rate of extension and contraction Rs of the film 12 after the fixing processing in the transportation direction, based on the transportation speeds Va and Vb of the film 12 which are obtained by the speed obtaining section 92. The extension-and-contraction obtaining section 90 uses a width dimension of the film roll 24 which is loaded in the supply section 16 as a width dimension Wb of the film 12 before the fixing processing. The extension-and-contraction obtaining section 90 obtains a rate of extension and contraction Rw of the film 12 after the fixing processing in the width direction, based on the width dimension Wa of the film 12 after the fixing processing, which is obtained by the width obtaining section 96, and the width dimension Wb. In the second exemplary embodiment, each of the rates of extension and contraction Rs and Rw functions as an example of the amount of extension and contraction. The rate of extension and contraction Rw of the film 12 in the width direction is obtained, for example, based on a ratio of the width dimensions (for example, $Rw=((Wa/Wb)-1)\times 100(\%)$, extension when $Rw>0$, and contraction when $Rw<0$). The rate of extension and contraction Rs and the rate of extension and contraction Rw are obtained, and thus the extension and contraction of an image which is formed on the film 12 in the transportation direction of the film 12 and in the width direction of the film 12 are predicted.

The fixing controller 84 sets the correction value of the fixation temperature Tf such that the extension and contraction of an image which is formed on the film 12 are in an allowable range which is set in advance. Data (for example, a table) regarding of variation in the rate of extension and contraction Rs of the film 12 in the transportation direction and variation in the rate of extension and contraction Rw of the film 12 in the width direction for temperature variation (temperature $\Delta T$) in the fixation temperature is obtained in advance and stored in the fixing controller 84. The fixing controller 84 corrects the fixation temperature Tf based on the table which is stored in advance such that each of the rate of extension and contraction Rs of the film 12 in the transportation direction and the rate of extension and contraction Rw of the film 12 in the width direction is in the preset allowable range. When a correction value which is obtained from the rate of extension and contraction Rs is different from a correction value which is obtained from the rate of extension and contraction Rw, any one of the correction values may be used and an average value of the correction values may be used.

The fixing controller 84 controls the heater 54 such that the outer circumference surface of the fixing roll 50 has the corrected fixation temperature Tf, whereby the fixing processing is performed. Accordingly, the film 12 which is subjected to the fixing processing by the fixing section 28A, and an image which is formed on the film 12 have the suppressed extension and contraction in the transportation direction and in the width direction.

In the second exemplary embodiment, the rotation roll 80 and the R-encoder 94 are provided so as to detect the transportation speed Vb before the fixing processing. However, the transportation speed Vb before the fixing processing may be detected by using the transportation speed of the film 12 which is set on the transporting path 20 of the image forming apparatus 10. The photoelectric sensor 76 (76L and 76R) which functions as a second width detection unit may be provided on the upstream side of the fixing roll 50 and the pressure roll 52, and the width dimension Wb may be obtained from a detection result of the photoelectric sensor 76 which is provided on the upstream side.

In the second exemplary embodiment, a case where the photoelectric sensor 76 for detecting the width dimension in a manner of non-contact with the film 12 is used as an example of the first and the second width detection units is described, but it is not limited thereto. For example, a width detection unit having a contact type configuration or a non-contact type configuration which is well known may be applied as the first and the second width detection units. An example of the known configuration is that a contact type edge sensor is provided so as to face both ends of the film 12 in the width direction.

Third Exemplary Embodiment

Next, the third exemplary embodiment will be described. In the third exemplary embodiment, functional components which are equivalent to those in the first exemplary embodiment or the second exemplary embodiment are denoted by the reference signs which are applied to the first exemplary embodiment or the second exemplary embodiment, and detailed descriptions thereof will be omitted.

Figure 7:
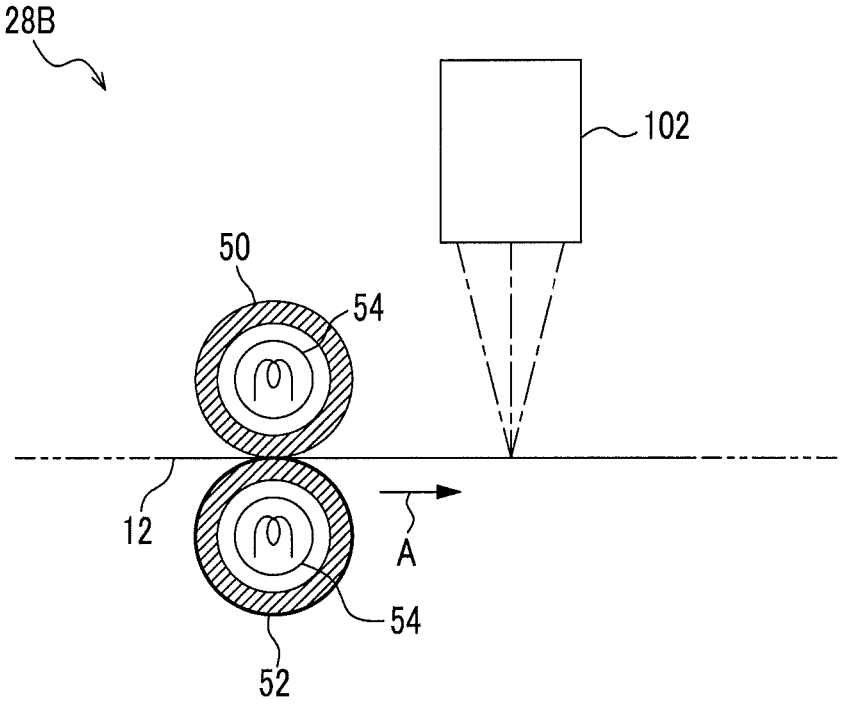
FIG. 7 is a configuration diagram of main components illustrating an example of a fixing section according to a third exemplary embodiment.
Figure 8:
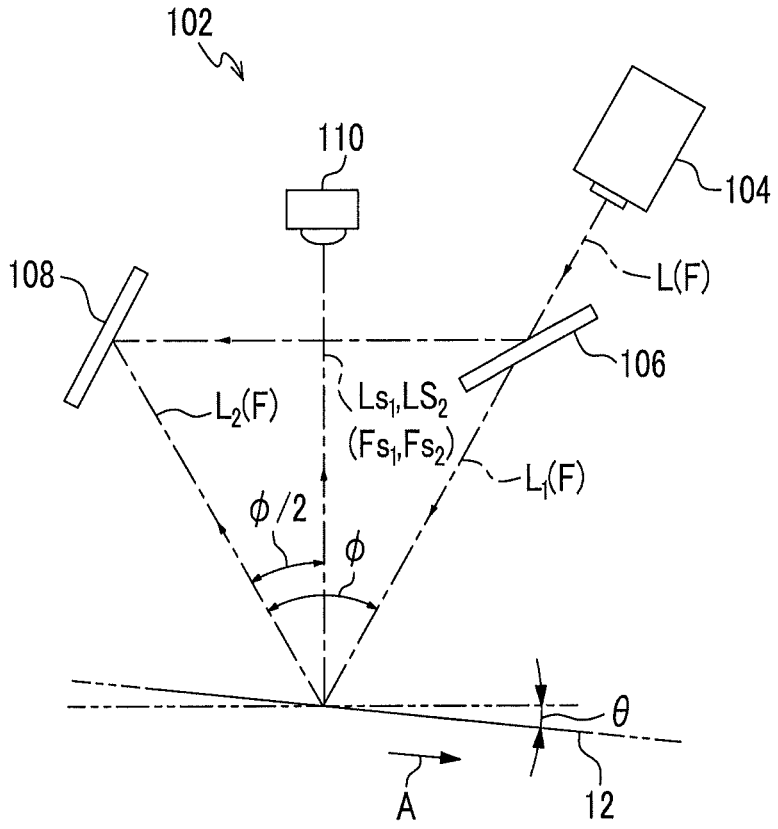
FIG. 8 is a configuration diagram illustrating main components of a speedometer according to the third exemplary embodiment.
Figure 9:
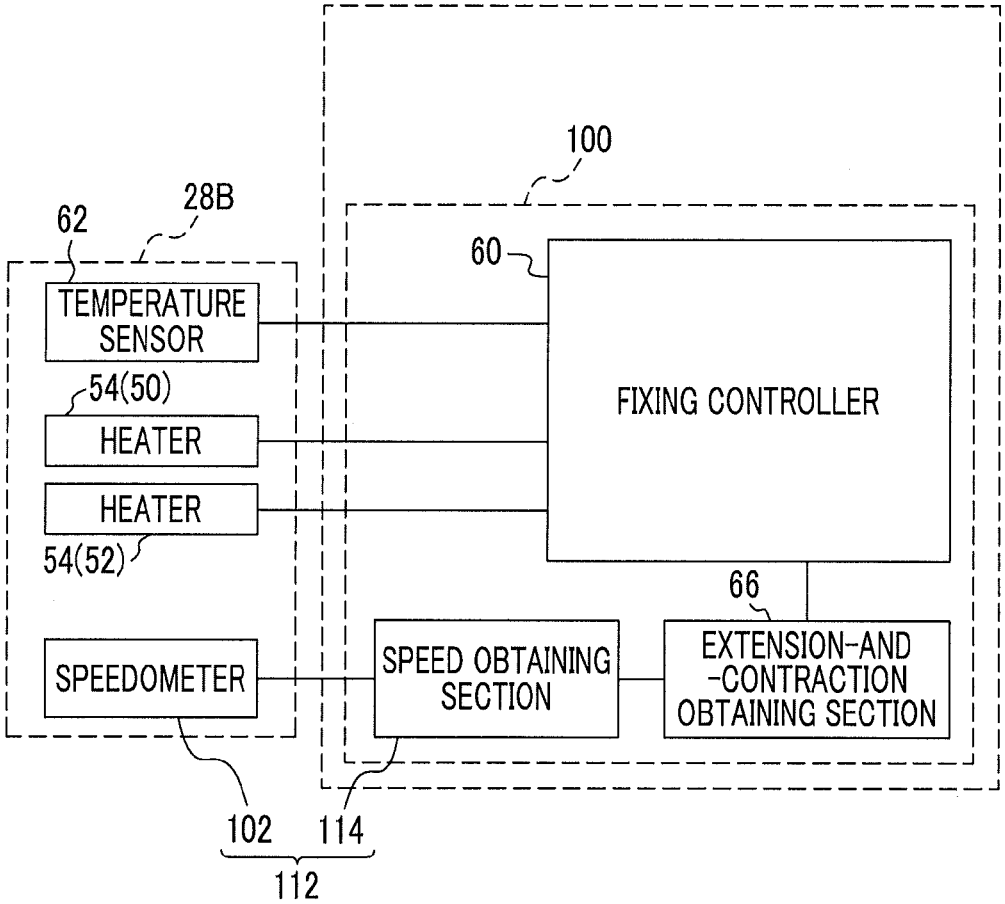
FIG. 9 is a configuration diagram of main components illustrating an example of a fixation control section according to the third exemplary embodiment.

FIG. 7 illustrates an example of a fixing section 28B according to the third exemplary embodiment. FIG. 8 illustrates an example of a speed detection unit according to the third exemplary embodiment. FIG. 9 illustrates an example of a fixation control section 100 for controlling an operation of the fixing section 28B according to the third exemplary embodiment. In the third exemplary embodiment, the fixing section 28B and the fixation control section 100 function as an example of the fixing unit.

As illustrated in FIG. 7, the fixing section 28B includes a laser doppler speedometer (below referred to as a speedometer 102) instead of the rotation rolls 68 and 70 which are used in the first exemplary embodiment. In the third exemplary embodiment, the speedometer 102 functions as an example of the first speed detection unit. The speedometer 102 is provided on a downstream side of the fixing roll 50 and the pressure roll 52 so as to face a surface of the film 12. In the third exemplary embodiment, the speedometer 102 is provided so as to face the surface of the film 12. However, the speedometer 102 may be provided so as to face a back surface of the film 12.

As illustrated in FIG. 8, the speedometer 102 includes a laser beam source 104, a beam splitter 106, a reflective mirror 108, and a light receiving device 110. The speedometer 102 detects the transportation speed of the film 12 by using the Doppler effect. A laser beam source 114 emits a laser beam L which has a preset frequency F (wavelength $\lambda=1/F$). The beam splitter 106 divides the laser beam L which is emitted from the laser beam source 104 into laser beams $L_1$ and $L_2$, each laser beam having the frequency F. The surface of the film 12 is irradiated with one laser beam (for example, the laser beam $L_1$) obtained by division of the beam splitter 106, from the downstream side in the transportation direction. Another laser beam (for example, the laser beam $L_2$) obtained by division of the beam splitter 106 is reflected by the reflective mirror 108, and is applied from the upstream side of the film 12 in the transportation direction such that an optical axis of the laser beam $L_2$ intersects with an optical axis of the laser beam $L_1$ on the surface of the film 12. At this time, an angle of the optical axis of the laser beam $L_2$ and the optical axis of the laser beam $L_1$ is a crossing angle $\phi$.

As the light receiving device 110, an optical detection element such as a photodiode and a photo-transistor may be used. The light receiving device 110 receives a reflected beam $Ls_1$ of the laser beam $L_1$ and a reflected beam $Ls_2$ of the laser beam $L_2$ which are scattered and reflected on the surface of the film 12. At this time, the reflected beams $Ls_1$ and $Ls_2$ which are received by the light receiving device 110 have an angle of $\phi/2$ which is an angle of optical axes of the laser beams $L_1$ and $L_2$.

Here, the Doppler effect occurs in the reflected beams $Ls_1$ and $Ls_2$ which are reflected by the film 12. One of a frequency $Fs_1$ of the reflected beam $Ls_1$ and a frequency of $Fs_2$ of the reflected beam $Ls_2$ varies (increases) in a positive direction in accordance with a movement speed of the film 12, and another varies (reduces) in a negative direction in accordance with the movement speed. Accordingly, a frequency Fd of a laser beam which is received by the light receiving device 110 is indicated as follows.

$$Fd=|Fs_1-Fs_2|$$

If the movement speed of the film 12 is set as v, and an angle of the film 12 to a vertical line of the optical axes of the reflected beams $Ls_1$ and $Ls_2$ which are reflected toward the light receiving device 110 is set as an inclination angle $\theta$, the frequency Fd is obtained as follows.

$$Fd=(2v/\lambda)\cdot\sin(\phi/2)\cdot\cos\theta$$

Accordingly, the light receiving device 110 receives the reflected beams $Ls_1$ and $Ls_2$, and heterodyne detection is performed on the reflected beams $Ls_1$ and $Ls_2$, whereby an electrical signal having the frequency Fd corresponding to the transportation speed v of the film 12 is obtained and the transportation speed v of the film 12 is obtained from the obtained electrical signal. Accordingly, the speedometer 102 is provided so as to face the surface of the film 12 after the fixing processing, whereby an electrical signal having the frequency Fd corresponding to the transportation speed Va of the film 12 after the fixing processing is output from the speedometer 102.

As illustrated in FIG. 9, the fixation control section 100 includes the fixing controller 60, a speed detection section 112, and the extension-and-contraction obtaining section 66. In the third exemplary embodiment, the speed detection section 112 and the extension-and-contraction obtaining section 66 function as an example of the detection unit. The fixing controller 60 functions as the fixing unit and functions as an example of the suppression unit. The speed detection section 112 includes the speedometer 102 and the speed obtaining section 114. The speed obtaining section 114 obtains the transportation speed Va of the film 12 after the fixing processing from the electrical signal having the frequency Fd which is input from the speedometer 102, and outputs the obtained transportation speed Va to the extension-and-contraction obtaining section 66.

In the fixing section 28B according to the third exemplary embodiment, the transportation speed Va of the film 12 after the fixing processing is measured with high accuracy in a state where there is no contact with the film 12. Accordingly, in the fixing section 28B, the fixation temperature Tf is corrected based on the measured transportation speed Va, and the extension and contraction of the film 12 after the fixing processing and the extension and contraction of an image which is formed on the film 12 are suppressed.

Figure 10:
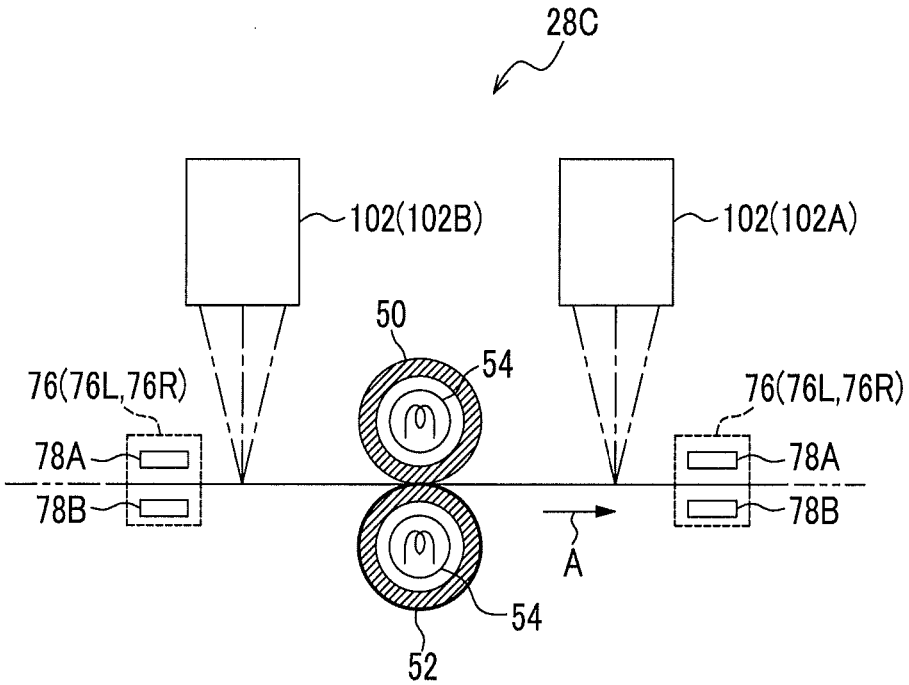
FIG. 10 is a configuration diagram of main components illustrating another example of the fixing section according to the third exemplary embodiment.

FIG. 10 illustrates another example of the fixing section using the speedometer 102 according to the third exemplary embodiment. A fixing section 28C illustrated in FIG. 9 includes two speedometers 102. One speedometer 102 (below referred to as a speedometer 102A) is disposed to face the surface of the film 12 after the fixing processing. Another speedometer 102 (below referred to as a speedometer 102B) is disposed on an upstream side of the fixing roll 50 and the pressure roll 52, and is used for detecting the transportation speed Vb of the film 12 before the fixing processing. The speedometer 102B functions as an example of the second speed detection unit.

Thus, in the fixing section 28C, not only the transportation speed Va of the film 12 after the fixing processing is obtained by the speedometer 102A and also the transportation speed Vb of the film 12 before the fixing processing is obtained by the speedometer 102B. In the fixing section 28C, the fixation temperature Tf is corrected based on the transportation speed Va of the film 12 after the fixing processing, which is obtained by the speedometer 102A and the transportation speed Vb of the film 12 before the fixing processing, which is obtained by the speedometer 102B. Accordingly, in the fixing section 28C, the extension and contraction which occur in the film 12 after the fixing processing, and the extension and contraction of an image which is formed on the film 12 are suppressed.

In the fixing section 28C, a width detection unit such as the photoelectric sensor 76 (76L and 76R) which functions as an example of the first width detection unit may be disposed on a downstream side of the fixing roll 50 and the pressure roll 52 (for example, a downstream side of the speedometer 102A in the transportation direction of the film 12). In the fixing section 28C, a width detection unit such as the photoelectric sensor 76 (76L and 76R) which functions as an example of the second width detection unit may be disposed on the upstream side of the fixing roll 50 and the pressure roll 52 (for example, an upstream side of the speedometer 102B in the transportation direction of the film 12). The fixing section 28C may correct the width dimension Wa which is detected by the width detection unit such as the photoelectric sensor 76, or the fixation temperature Tf including the rate of extension and contraction Rw of the film 12 in the width direction which is obtained from the width dimension Wa and the width dimension Wb.

Fourth Exemplary Embodiment

Next, the fourth exemplary embodiment will be described. In the fourth exemplary embodiment, functional components which are equivalent to those in the first, the second, or the third exemplary embodiments are denoted by the reference signs which are applied to the first, the second, or the third exemplary embodiments, and detailed descriptions thereof will be omitted.

Figure 11:
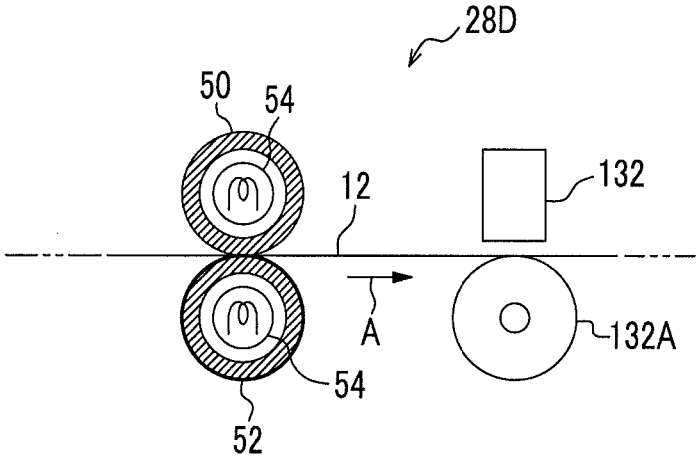
FIG. 11 is a configuration diagram of main components illustrating an example of a fixing section according to a fourth exemplary embodiment.
Figure 12:
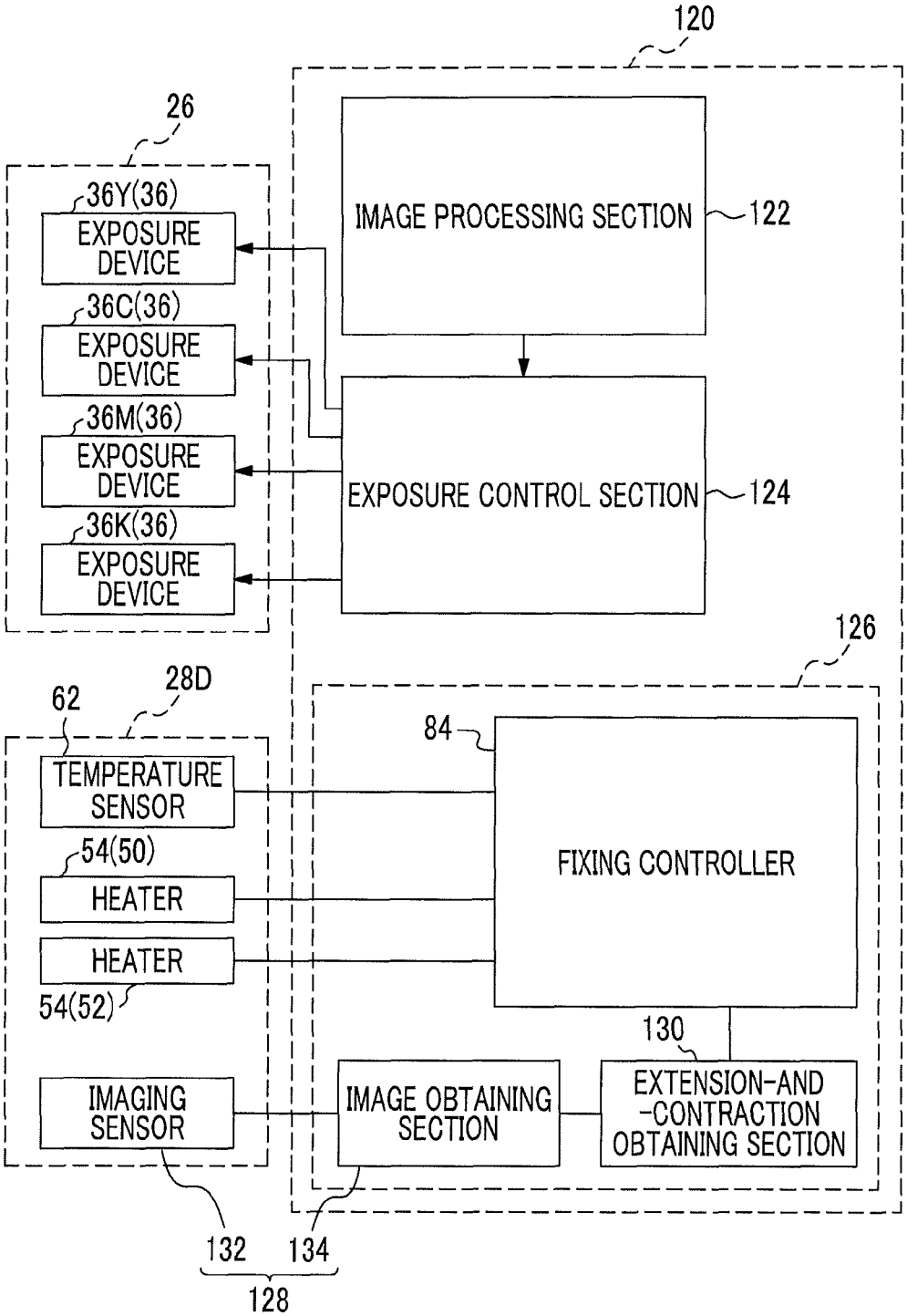
FIG. 12 is a configuration diagram of main components illustrating an example of a control section according to the fourth exemplary embodiment.

FIG. 11 illustrates main components of a fixing section 28D according to the fourth exemplary embodiment. FIG. 12 illustrates an example of a control section 120 for controlling an operation of the image forming apparatus according to the fourth exemplary embodiment. As illustrated in FIG. 12, the control section 120 includes an image processing section 122, an exposure control section 124, and a fixation control section 126. In the fourth exemplary embodiment, the fixing section 28D and the fixation control section 124 function as an example of the fixing unit, and the image processing section 122 and the exposure control section 124 function as an example of an indicator forming unit. For example, the control section 120 includes a computer. A CPU of the computer executes an image processing program, an exposure control program, and a fixation control program, whereby the computer is caused to function as the image processing section 122, the exposure control section 124, and the fixation control section 126. A general configuration in which an operation of the image forming apparatus that forms an image on the film 12 using the electrophotographic process is controlled may be applied in the control section 120. In the fourth exemplary embodiment, detailed descriptions of an operation of the control section 120 will be omitted.

The image processing section 122 performs an image processing which has been set in advance, for image data. The image processing section 122 performs color separation on the image data which is subjected to the image processing, and thus generates raster data for each color of Y, M, C, and K, for example. The exposure control section 124 controls the exposure device 36 (36Y, 36M, 36C, and 36K) which is provided in the image forming unit 30, based on the raster data for each color which is generated by the image processing section 122. Accordingly, a developer image corresponding to the image data is formed on the film 12.

The fixation control section 126 includes the fixing controller 84, a detection section 128, and an extension-and-contraction obtaining section 130. In the fourth exemplary embodiment, the fixing controller 84 functions as the fixing unit, and functions as an example of the suppression unit. The detection section 128 and the extension-and-contraction obtaining section 130 function as an example of the detection unit. The detection section 128 includes an imaging sensor 132 and an image obtaining section 134. In the fourth exemplary embodiment, the imaging sensor 132 and the image obtaining section 134 function as an example of the image reading unit.

As illustrated in FIG. 11, the imaging sensor 132 is disposed on the downstream side of the fixing roll 50 and the pressure roll 52 in the fixing section 28D so as to face the surface of the film 12. For example, a CCD line sensor and the like is used as the imaging sensor 132, and an image reading line is disposed in the width direction (direction directed to a back surface of paper in FIG. 11) of the film 12. A rotation roll 132A for backup is disposed in the fixing section 28D. An outer circumference surface of the rotation roll 132A comes into contact with the back surface of the film 12 which corresponds to the image reading line of the imaging sensor 132 and the rotation roll 132A rotates with tracking of transportation of the film 12. Regarding of the film 12 which comes into contact with the rotation roll 132A and is transported, for example, the imaging sensor 132 reads an image which is formed on the film 12, by using the width direction of the film 12 which is set as a main scanning direction and the transportation direction of the film 12 which is set as a sub-scanning direction.

Here, a preset area of the film 12 on which an image is formed may be used, for example, cut out in post-processing after image formation, and the preset area includes an image area. Accordingly, in this case, both end portions in the width direction and a preset area in the transportation direction are set as an unuse area.

Thus, in the fourth exemplary embodiment, an indicator is formed in a preset area such as the unuse area of the film 12 and the imaging sensor 132 reads the preset area on the film 12 including the formed indicator. Image data of an indicator is stored in a storage unit (not illustrated) of the image processing section 122 illustrated in FIG. 12. The image processing section 122 generates raster data such that an indicator is formed at a preset position on the film 12. Accordingly, the indicator is formed as a developer image at the preset position on the film 12 which is subjected to developing processing by the developing section 26, and the fixing processing is performed on the indicator. Consequently, the developer image of the indicator is fixed on the film 12.

The imaging sensor 132 is connected to the image obtaining section 134. The image obtaining section 134 reads an area including an image of the indicator which is formed on the film 12 by the imaging sensor 132. The image obtaining section 134 obtains a dimension on the film 12, which is set in advance in order to detect the amount of extension and contraction of the film 12, from the area including the image of the indicator, which is read from the film 12. The extension-and-contraction obtaining section 130 obtains the rate of extension and contraction Rs and the rate of extension and contraction Rw in the transportation direction of the film 12, based on the dimension obtained by the image obtaining section 134. In the fourth exemplary embodiment, each of the rates of extension and contraction Rs and Rw functions as an example of the amount of extension and contraction. The fixing controller 84 corrects the fixation temperature Tf based on the rates of extension and contraction Rs and Rw which are obtained by the extension-and-contraction obtaining section 130.

Figure 13:
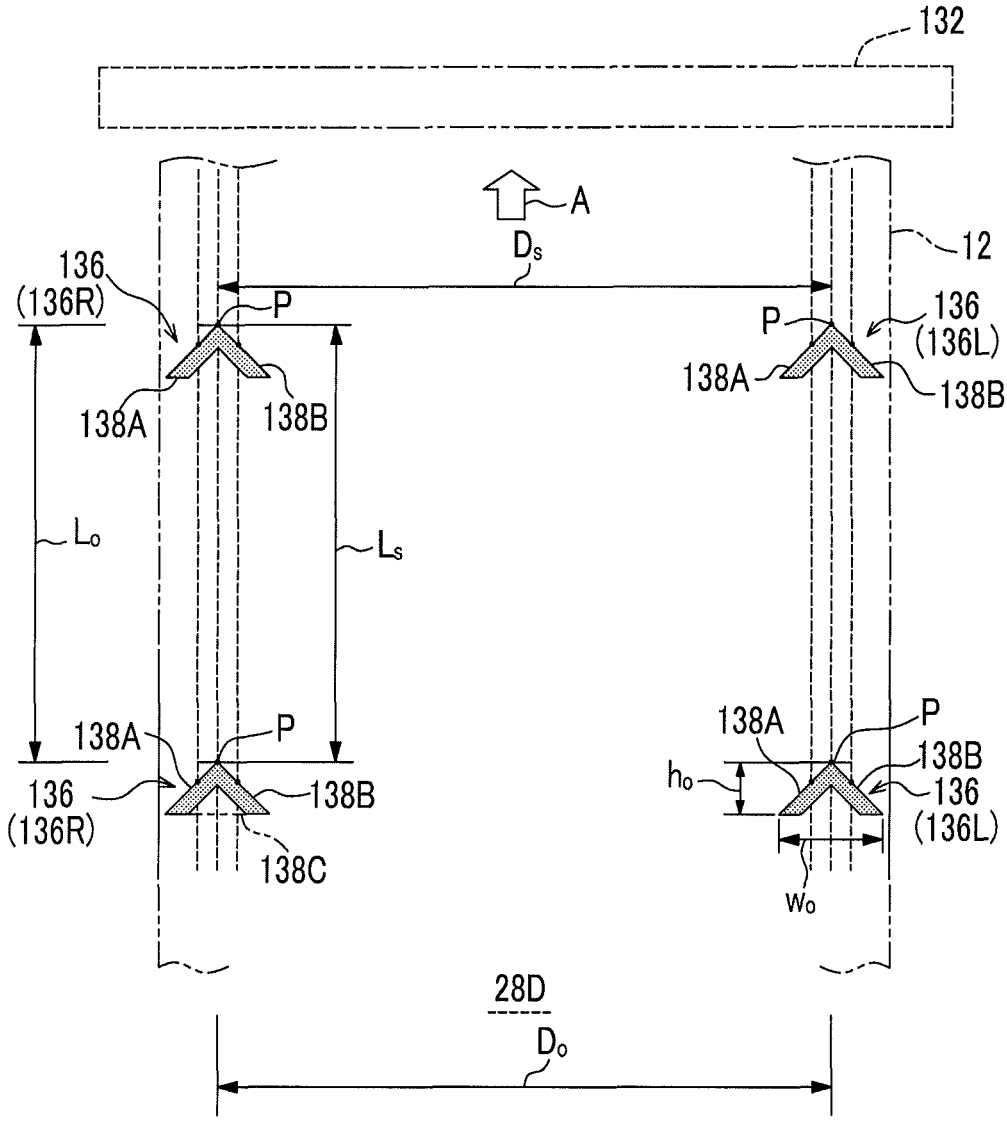
FIG. 13 is a plan view of main components of a film illustrating an example in which a mark is formed on the film, according to the fourth exemplary embodiment.

FIG. 13 illustrates an example of the indicator which is formed on the film 12. In the fourth exemplary embodiment, a mark 136 is used as an example of the indicator. The mark 136 has an appearance of a triangle, and is formed such that band-like lines 138A and 138B which are formed along two sides which are connected to one vertex P intersect with each other at a preset angle (for example, 90°). The mark 136 has a line of symmetry which is a line passing through the vertex P, and has a shape in which the lines 138A and 138B are formed to reach a base 138C of the mark 136.

The mark 136 is formed as a developer image on the film 12 such that a height which is a distance between the vertex P and the base 138C becomes a preset height $h_0$, and a width dimension which is the length of the base 138C becomes a preset width dimension $w_0$. The developer image of the mark 136 is formed on the film 12 such that the vertex P is positioned on a downstream side of the film 12 in the transportation direction and the line of symmetry is positioned along the transportation direction.

In the fourth exemplary embodiment, as an example, the mark 136 is formed at both of the end portions of the film 12 in the width direction such that a distance between vertices P becomes a preset distance $D_0$. In the fourth exemplary embodiment, as an example, the mark 136 is formed such that a distance in the transportation direction of the film 12 between vertices P becomes a preset distance $L_0$. In the fourth exemplary embodiment, the distance $L_0$ functions as an example of a transportation direction dimension between indicators and the distance $D_0$ functions as an example of a width direction dimension between the indicators. When the marks 136 at both of the end portions of the film in the width direction are required to be distinguished, one mark is set as a mark 136L, and another mark is set as a mark 136R. The mark 136 is formed by using any one color of Y, M, C, and K, or using at least two colors of Y, M, C, and K. When the image forming apparatus includes an image forming unit for a color which is different from Y, M, C, and K, the mark 136 may be formed by using the color of the image forming unit.

When the marks 136L and 136R which are formed at both of the end portions of the film 12 in the width direction are detected, the image obtaining section 134 obtains a distance Ds between a vertex P of the mark 136L and a vertex P of the mark 136R from the image data which is read by the imaging sensor 132. If the image obtaining section 134 detects the mark 136 (136A or 136B), and then detects the next mark 136, the image obtaining section 134 obtains a distance Ls between a vertex P of the mark 136 which is detected for the first time, and a vertex P of the mark 136 which is detected next. The number of pixels in image data or the like may be used for the distance Ds and the distance Ls.

The distance Ds which is obtained by the image obtaining section 134 corresponds to the distance $D_0$ between the vertices P of the marks 136L and 136R which are formed at both of the end portions of the film 12 before the fixing processing in the width direction. The distance Ls corresponds to the distance $L_0$ between vertices P of two marks 136 which are adjacent to each other in the transportation direction.

The extension-and-contraction obtaining section 130 illustrated in FIG. 12 obtains the rate of extension and contraction Rs of the film 12 after the fixing processing based on the distance Ls and the distance $L_0$. The extension-and-contraction obtaining section 130 obtains the rate of extension and contraction Rw of the film 12 after the fixing processing based on the distance Ds and distance $D_0$. That is, the distance Ls between the marks 136 in the transportation direction of the film 12 varies depending on the extension and contraction which occur in the transportation direction of the film 12. The rate of extension and contraction Rs is obtained from the distance $L_0$ and the distance Ls by using $Rs=((Ls/L_0)-1)\times 100$ (%), for example. The distance Ds between the marks 136L and 136R at both of the end portions of the film 12 in the width direction varies depending on the extension and contraction which occur in the width direction of the film 12. The rate of extension and contraction Rw is obtained by using $Rw=((Ds/D_0)-1)\times 100(\%)$, for example.

The fixing controller 84 corrects the fixation temperature based on the rate of extension and contraction Rs and the rate of extension and contraction Rw which are obtained by the extension-and-contraction obtaining section 130. Thus, in the fixing section 28D, the fixation temperature Tf is corrected in accordance with the extension and contraction which occur in the film 12. The extension and contraction of the film 12 after the fixing processing and the extension and contraction of an image which is formed on the film 12 are suppressed.

In the fourth exemplary embodiment, the marks 136L and 136R which are formed at both of the end portions of the film 12 in the width direction, and at least two marks 136 which are formed in the transportation direction are used, but it is not limited thereto. For example, the mark 136 is formed to have the height $h_0$ and the width dimension $w_0$ which are defined in advance. For this reason, the height h and the width dimension w of one mark 136 may be detected and the rates of extension and contraction Rs and Rw may be obtained from the height h and the width dimension w which are detected.

The marks 136 may be formed in positions which are set in advance in the width direction, such as one end portion of the film 12 in the width direction, at the preset distance $L_0$ in the transportation direction. The fixation temperature Tf may be corrected by using the rate of extension and contraction Rs which is obtained from at least two marks 136.

In the fourth exemplary embodiment, the mark 136 is used as an indicator which is used for speed detection. However, the indicator is not limited to the mark 136, and may use an image having any shape. For example, so-called dragonflies may be formed at a preset position of the film 12 in the width direction on the film 12 on which an image is formed, with a preset distance in the transportation direction of the film 12. The so-called dragonfly is an indicator having a cross shape, an L-shape, or a T-shape which is used in estimation and match of the image which is formed on the film 12. A dragonfly and the like for estimation and match may be used in detection of the amount of extension and contraction of the film 12.

In the fourth exemplary embodiment, the imaging sensor 132 is provided on the downstream side of the fixing roll 50 and the pressure roll 52 so as to read the mark 136 on the film 12 which is subjected to the fixing processing. However, the position of the imaging sensor 132 is not limited thereto. For example, the imaging sensor 132 may be also disposed on the upstream side of the fixing roll 50 and the pressure roll 52 and read the mark 136 before the fixing processing. Thus, a distance between the marks 136 before the fixing processing in the transportation direction, and a distance between the marks 136 before the fixing processing in the width direction may be obtained. With this, the distance between the marks 136 in the transportation direction and the distance between the marks 136 in the width direction before and after the fixing processing are obtained, and the extension and contraction which occur in the film 12 are detected based on the obtained distances with high accuracy.

As described above, in the first to the fourth exemplary embodiments, the amount of extension and contraction of the film 12 after the fixing processing is obtained, and the fixation temperature is corrected such that the rate of extension and contraction of the film 12 in the transportation direction, which is obtained from the amount of extension and contraction is suppressed. With this, the extension and contraction of an image which is formed on the film 12 is suppressed. The extension and contraction occurring in the film 12 is also suppressed.

In the second exemplary embodiment, the transportation speed Vb of the film 12 before the fixing processing is obtained in addition to the transportation speed Va of the film 12 after the fixing processing, and the fixation temperature is corrected such that the extension and contraction of the film 12 in the transportation direction which are obtained based on the transportation speeds Va and Vb are suppressed. With this, the fixation temperature is corrected more accurately than a case where only the transportation speed Va is detected and occurrence of the extension and contraction of an image which is formed on the film 12 and occurrence of the extension and contraction of the film 12 on which an image is formed is suppressed.

In the exemplary embodiments, the extension and contraction of the film 12 are suppressed in accordance with the extension and contraction occurring in the film 12. Further, the extension and contraction occurring in the film 12 in addition to an image which is formed on the film 12 are suppressed. Accordingly, for example, even though the film 12 is divided by a preset size and thus an image which is formed on the film 12 is cut out, occurrence of poor finish such as a shift of a position of an image in an area obtained by cutting out the film 12 is prevented.

In the above-described exemplary embodiments, the fixation temperature is used as the fixation parameter and the fixation temperature is corrected. Thus, occurrence of the extension and contraction in a recording medium such as the film 12 is suppressed. However, it is not limited to the fixation temperature, and any fixation parameter may be used. As the fixation parameter, the fixation temperature, the fixation pressure, the transportation speed of the film 12, the tensile strength (tension) which is applied to the film 12, and the like may be used. Thus, at least one fixation parameter among these fixation parameters may be used for correction. For example, regarding of the fixation pressure, a configuration and the like in which a pressure adjustment mechanism is provided in the pressure roll 52, and thus pressure in accordance with the amount of extension and contraction which is detected from the film 12 is adjusted may be applied. Regarding of the transportation speed and the tensile strength, a configuration and the like in which a buffer section is provided on the upstream side of the fixing section, the buffer section causes transportation of the film to the fixing section to be temporarily delayed, and at least one of a speed adjustment section for adjusting the transportation speed and a tensile strength adjustment section for adjusting tensile strength is provided on a downstream side of the buffer section may be applied.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a fixing unit that fixes a developer image which is formed on a thermoplastic recording medium by performing fixing processing that causes the recording medium on which the developer image is formed to be heated and pressed with transportation based on a plurality of fixation parameters;

a detection unit that detects an amount of extension and contraction which occurs in the recording medium by the fixing processing; and a suppression unit that controls at least one of the plurality of fixation parameters and suppresses the amount of extension and contraction which is detected by the detection unit.

2. The image forming apparatus according to claim 1, wherein the amount of extension and contraction corresponds to a rate of extension and contraction which is indicated by a ratio of a transportation speed of the recording medium before the fixing processing and a transportation speed of the recording medium after the fixing processing.

3. The image forming apparatus according to claim 2, wherein the detection unit detects the transportation speed of the recording medium after the fixing processing with using a first speed detection unit which is disposed on a downstream side of the fixing unit in a transportation direction.

4. The image forming apparatus according to claim 3, wherein the detection unit detects the transportation speed of the recording medium before the fixing processing with using a second speed detection unit which is disposed on an upstream side of the fixing unit in the transportation direction.

5. The image forming apparatus according to claim 2, wherein the amount of extension and contraction corresponds to the rate of extension and contraction which is indicated by a ratio of a width of the recording medium before the fixing processing and a width of the recording medium after the fixing processing.

6. The image forming apparatus according to claim 5, wherein the detection unit detects the width of the recording medium after the fixing processing with using a first width detection unit which is disposed on a downstream side of the fixing unit in a transportation direction.

7. The image forming apparatus according to claim 6, wherein the detection unit detects the width of the recording medium before the fixing processing with using a second width detection unit which is disposed on an upstream side of the fixing unit in the transportation direction.

8. The image forming apparatus according to claim 1, wherein the amount of extension and contraction corresponds to the rate of extension and contraction which is indicated by a ratio of a dimension before the fixing processing and a dimension after the fixing processing, the dimensions being obtained based on an indicator which is formed as the developer image.

9. The image forming apparatus according to claim 8, wherein the detection unit uses a transportation direction dimension between indicators which are formed on the recording medium at a preset distance along the transportation direction, as the dimension, reads the indicators with using an image reading unit which is disposed on a downstream side of the fixing unit in the transportation direction, and detects a ratio of a transportation direction dimension between the indicators before the fixing processing and a transportation direction dimension between the indicators after the fixing processing, as the rate of extension and contraction.

10. The image forming apparatus according to claim 9, wherein the detection unit uses a width direction dimension between indicators which are formed on the recording medium at a preset distance along a width direction, as the dimension, reads the indicators with using the image reading unit, and detects a ratio of a width direction dimension between the indicators before the fixing processing and a width direction dimension between the indicators after the fixing processing, as the rate of extension and contraction.

11. The image forming apparatus according to claim 8, further comprising:

an indicator forming unit that forms the developer image of the indicator on the recording medium.

12. An image forming apparatus comprising:

a fixing unit that fixes a developer image which is formed on a thermoplastic recording medium by a fixing processing while the recording medium on which the developer image is formed is transported, the recording medium being heated and pressed in the fixing processing;

a detection unit that detects an amount of extension and contraction which occurs in the recording medium by the fixing processing; and a suppression unit that controls a fixation temperature which corresponds to a heating temperature of the recording medium and suppresses the amount of extension and contraction which is detected by the detection unit.

13. The image forming apparatus according to claim 12, wherein the amount of extension and contraction corresponds to a rate of extension and contraction which is indicated by a ratio of a transportation speed of the recording medium before the fixing processing and a transportation speed of the recording medium after the fixing processing.

14. The image forming apparatus according to claim 13, wherein the detection unit detects the transportation speed of the recording medium after the fixing processing with using a first speed detection unit which is disposed on a downstream side of the fixing unit in a transportation direction.

15. The image forming apparatus according to claim 14, wherein the detection unit detects the transportation speed of the recording medium before the fixing processing with using a second speed detection unit which is disposed on an upstream side of the fixing unit in the transportation direction.

16. The image forming apparatus according to claim 13, wherein the amount of extension and contraction corresponds to the rate of extension and contraction which is indicated by a ratio of a width of the recording medium before the fixing processing and a width of the recording medium after the fixing processing.

17. The image forming apparatus according to claim 16, wherein the detection unit detects the width of the recording medium after the fixing processing with using a first width detection unit which is disposed on a downstream side of the fixing unit in a transportation direction.

18. The image forming apparatus according to claim 17, wherein the detection unit detects the width of the recording medium before the fixing processing with using a second width detection unit which is disposed on an upstream side of the fixing unit in the transportation direction.

19. The image forming apparatus according to claim 12, wherein the amount of extension and contraction corresponds to the rate of extension and contraction which is indicated by a ratio of a dimension before the fixing processing and a dimension after the fixing processing, the dimensions being obtained based on an indicator which is formed as the developer image.

20. The image forming apparatus according to claim 19, further comprising:

an indicator forming unit that forms the developer image of the indicator on the recording medium.

* * * * *